US006213326B1

(12) United States Patent
Denner et al.

(10) Patent No.: US 6,213,326 B1
(45) Date of Patent: Apr. 10, 2001

(54) GRIPPABLE BLOW-MOLDED CONTAINER PROVIDING BALANCED POURING CAPABILITY

(75) Inventors: John E. Denner, Dover; Richard K. Ogg, Littlestown; Sheldon E. Yourist, York, all of PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 09/327,261

(22) Filed: Jun. 7, 1999

Related U.S. Application Data

(60) Provisional application No. 60/088,557, filed on Jun. 9, 1998.

(51) Int. Cl.[7] ..... B65D 90/02
(52) U.S. Cl. ..... 215/383; 215/384; 220/671
(58) Field of Search ..... D9/542, 543, 537, D9/538, 539; 215/383, 381, 382, 384; 220/669, 670, 672, 675, 671

(56) References Cited

U.S. PATENT DOCUMENTS

| | | | | |
|---|---|---|---|---|
| D. 92,953 | | 8/1934 | Gaynor . | |
| D. 188,817 | * | 9/1960 | Northrup | D9/383 |
| D. 200,603 | * | 3/1965 | Petitto | D9/538 |
| D. 214,423 | * | 6/1969 | Linn | D9/538 X |
| D. 218,020 | * | 7/1970 | Musson | D9/538 X |
| D. 225,510 | * | 12/1972 | Straud | D9/538 X |
| D. 247,469 | * | 3/1978 | Plummer | D9/538 X |
| D. 322,562 | * | 12/1991 | Narsutis | D9/538 X |
| D. 340,190 | | 10/1993 | Skidmore et al. . | |
| D. 374,826 | | 10/1996 | Mackinson . | |
| D. 378,353 | | 3/1997 | Emre et al. . | |
| D. 379,151 | * | 5/1997 | Stevens | D9/503 |
| D. 387,279 | | 12/1997 | Emre et al. . | |
| D. 387,671 | * | 12/1997 | Panella | D9/538 |
| D. 393,802 | | 4/1998 | Collette et al. . | |
| D. 395,008 | * | 6/1998 | Kuzma et al. | D9/538 X |
| D. 398,538 | | 9/1998 | Fuquen et al. . | |
| 3,185,353 | * | 5/1965 | Mercier | 215/384 X |
| 4,863,046 | * | 9/1989 | Collette et al. | 215/383 |
| 5,178,289 | | 1/1993 | Krishnakumar et al. . | |
| 5,261,543 | | 11/1993 | Ugarelli . | |
| 5,350,078 | | 9/1994 | Potts et al. . | |
| 5,385,250 | | 1/1995 | Pasquale . | |
| 5,632,397 | | 5/1997 | Fandeux et al. . | |
| 5,732,838 | | 3/1998 | Young . | |
| 5,758,790 | * | 6/1998 | Ewing, Jr. | 215/384 |
| 5,803,290 | | 9/1998 | Bongiorno . | |

FOREIGN PATENT DOCUMENTS

WO 99/08945 2/1999 (WO) .

* cited by examiner

*Primary Examiner*—Allan N. Shoap
*Assistant Examiner*—Tri M. Mai
(74) *Attorney, Agent, or Firm*—Howson and Howson

(57) ABSTRACT

A container having a grip ring. The grip ring is located between a dome portion and a body portion of the container and has an inset grip surface for receiving a thumb and fingers. The grip ring is located and sized relative to the dome and body portions, such that, when the container is grasped about the grip ring, the container contents can be poured in a balanced and facile manner. In addition, the location and configuration of the grip ring provides the container with circumferential hoop strength which resists unwanted ovalization distortion of the dome and body portion of the container.

8 Claims, 6 Drawing Sheets

GRIPPABLE BLOW-MOLDED CONTAINER PROVIDING BALANCED POURING CAPABILITY

This application claim benefit to provisional Ser. No. 60/088,557 Jun. 9, 1998.

FIELD OF THE INVENTION

The present invention relates to a blow-molded plastic container specifically designed to enable gripping, lifting and pouring of the container contents in a facile manner, and more particularly, the present invention relates to a container having an inwardly extending waist which is located between a body portion and a dome portion of the container and which provides surfaces permitting grasping of the container.

BACKGROUND OF THE INVENTION

Blow-molded plastic containers have become commonplace in packaging beverages, such as juice, and other liquid products. Such a container normally has a dome extending from a finish, an annular sidewall extending from a base, and a waist connecting the dome to the sidewall. Typically, the containers have a horizontal cross section which is circular, rectangular or multi-faceted.

Various means permitting grasping, lifting and pouring of containers are known in the art. For example, containers have been provided with integrally formed, or separately attached, handles extending from the sidewall, dome or finish of the containers. Containers have also been provided with indented grip panels located in the body portions of container sidewalls.

Although various known blow-molded plastic containers having handles or grip panels may function satisfactorily for their intended purposes, there is a need for a blow-molded plastic container having an improved construction which enables gripping, lifting and pouring of the container contents in a facile manner. The container should be capable of resisting distortion due to hot-filling and compressive distortions due to top loading. A container having the improved construction should also be capable of being made from a minimum of plastic to afford efficient manufacture.

OBJECTS OF THE INVENTION

With the foregoing in mind, a primary object of the present invention is to provide a novel grippable blow-molded plastic container.

Another object of the present invention is to provide a grippable container which can be readily lifted and its contents poured in a balanced, facile manner.

A further object of the present invention is to provide a grippable container structure which is readily blow molded and which provides sufficient top loading capabilities to withstand the rigors of shipping and storage while resisting distortion due to hot-fill processing.

A still further object of the present invention is to provide a container having a grip structure which also provides circumferential hoop strength to resist dome/sidewall ovalization.

A still further object is to provide a grippable, blow molded plastic container which is inexpensive to manufacture, structurally sound, and aesthetically appealing.

SUMMARY OF THE INVENTION

More specifically, the present invention provides a grippable, blow-molded plastic container from which contents can be poured in a balanced manner. The container has a body portion and a dome portion each having predetermined volumes. The body portion volume is in a range of about 60% to about 70% of the overall volume of the container, and the dome portion volume is in a range of about 30% to about 40% of the overall volume of the container. A grip ring having a peripheral grip surface is located between and connects the dome portion and the body portion. The peripheral grip surface is provided by an inwardly and upwardly radially extending lower grip surface portion adjacent the body portion of the container and an inwardly and downwardly extending upper grip surface portion adjacent the dome portion of the container. The grip ring is located and sized relative to the body portion and dome as to enable gripping, lifting and pouring of the container contents in a facile manner.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

The present invention is a configuration for a blow molded plastic container which is readily gripped and lifted. The containers are intended to be of relatively large sizes, such as, 48 ounce, 64 ounce or one gallon size, which are generally difficult to grasp and pour in a relatively controlled, balanced manner.

A particular problem experienced with large containers is that, if the handle or grip panel is located too close to the finish or base of the container, the container is being gripped at a location too remote from the center of gravity of the container and its contents to permit relatively balanced and controllable pouring. Thus, one of the novel aspects of the container configuration according to the present invention is that it permits the contents of a relatively large-sized container to be poured in a balanced, controlled, and facile manner due to the relative location of the grip with respect to the container geometries.

Twelve embodiments of the present invention are illustrated herein. The illustrated containers are particularly suited for packaging beverages, such as juice, and can be designed to be hot or cold filled. As will be discussed in detail, all of the containers have grip rings, or waists, at strategic locations on the containers so that steady, balanced pouring can be accomplished when the container is grasped with a single hand. The grip rings are located between the domes and the body portions of the containers and provide an inset grip surface extending peripherally around the container. The volumes of the domes and body portions are specifically designed so that, when a container is grasped about the grip ring and its contents are poured, the grip location is adjacent the center of gravity of the container and its contents.

Figure 1A:
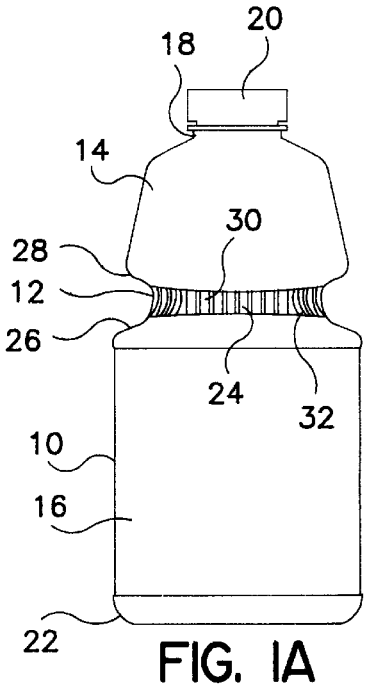
FIGS. 1A, 1B and 1C are elevational and perspective views of a first embodiment of a plastic container having a grip ring according to the present invention.
Figure 1B:
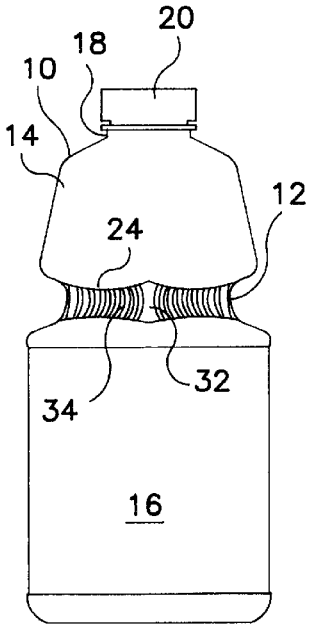
Figure 1C:
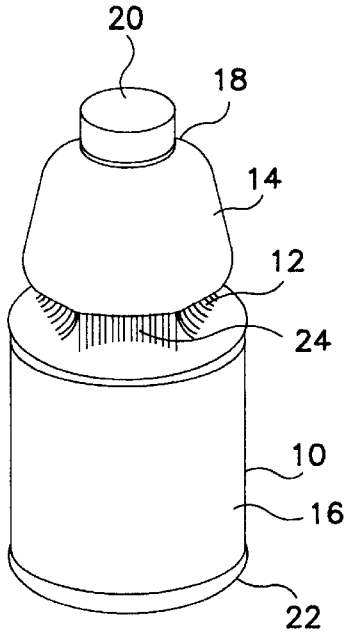

Turning to the first embodiment of the present invention which is illustrated in FIGS. 1A, 1B and 1C, a container 10 is provided with a grip ring 12 located between and connecting a frustoconical-shaped dome 14 and a body portion 16. A finish 18 is located at the top of the dome 14 and is engageable with a removable threaded closure 20, and a base 22 extends from the body portion 16. The body portion 16 has an annular horizontal cross-section; however, other shaped cross-sections could be utilized, such as, rectangular or multi-faceted. If the container 10 is intended for hot-filling, the body portion 16 is provided with a plurality of spaced-apart collapse, or vacuum flex, panels (not shown).

The grip ring 12 is inset along the periphery of the container 10 and provides grip, or digit-engageable, surfaces 24 for placement of a finger, or fingers, and a thumb to enable ready grasping and lifting of the container 10 with one hand. The grip ring 12 is formed by an inwardly and upwardly radially extending lower grip surface portion 26 adjacent the body portion 16, an inwardly and downwardly extending upper grip portion 28 adjacent the dome 14, and an intermediate grip surface 30 extending between the upper and lower grip surface portions, 26 and 28.

As illustrated, the grip ring 12 has five grip surfaces 24 which extend chordally relative to the container 10 in a multi-faceted configuration. Alternatively any number of facets, including an odd or even number of facets, could be utilized. An axially extending peripherally-spaced rib 32 is located at each end of each grip surface 24 to define the extent of each grip surface 24 and to provide post-like reinforcement to the container 10 to improve top loading and prevent unwanted distortion. Additional ribs 34 extend between the ribs 32 on each grip surface 24 to prevent slippage of fingers and thumbs relative to the grip surfaces 24 and to prevent unwanted distortion of the grip surfaces 24. Each grip surface 24 can be formed substantially planar between ribs 32 or can be curved inwardly, as illustrated, to provide pocket-like, digit-engageable surfaces 24.

In use, the container 10 is gripped about the grip ring 12 with a thumb located in one of the grip surfaces 24 and at least one finger located in a grip surface 24 located substantially opposite, although not necessarily directly opposite, the grip surface 24 engaged by the thumb. As the container 10 is tilted the center of gravity of the container 10 and its contents changes due to the contents flowing in a direction from the base 22 of the container 10 to, and out of, the finish 18 of the container 10. However, when the container 10 is substantially full, it is at its heaviest and is difficult to control and balance. The grip ring 12 is strategically located such that it is adjacent the center of gravity during pouring of a substantially, or partially, full container. Thus, it enables balanced, controllable and facile pouring.

The second and third embodiments of the present invention are similar to the first embodiment.

Figure 2A:
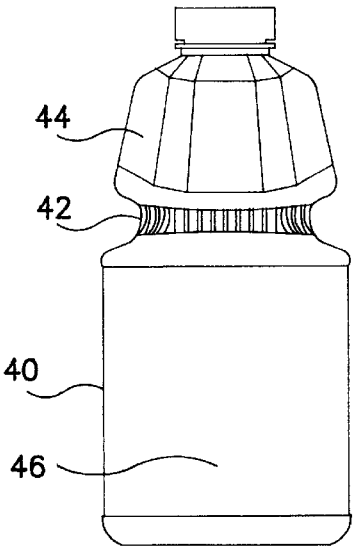
FIGS. 2A, 2B and 2C are elevational and perspective views of a second embodiment of a plastic container having a grip ring according to the present invention.
Figure 2B:
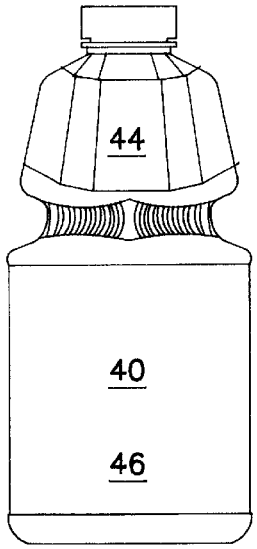
Figure 2C:
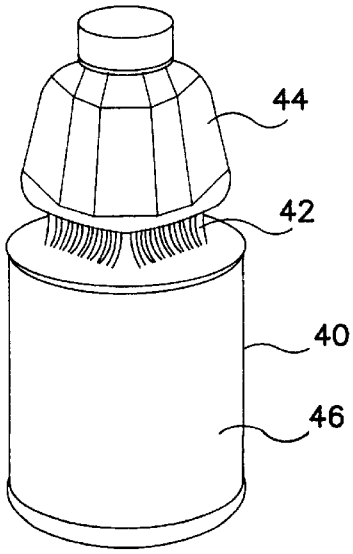

The second embodiment, illustrated in FIGS. 2A, 2B and 2C, provides a container 40 having a grip ring 42, a frustoconical-shaped dome 44 and a body portion 46. Container 40 is identical to the previously described container 10 except for the dome 44 has a multi-faceted configuration for aesthetic and dome reinforcement purposes.

Figure 3A:
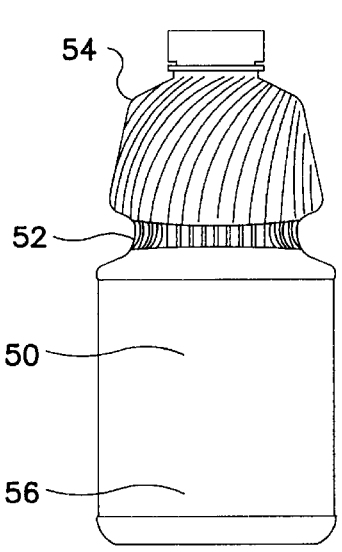
FIGS. 3A, 3B and 3C are elevational and perspective views of a third embodiment of a plastic container having a grip ring according to the present invention.
Figure 3B:
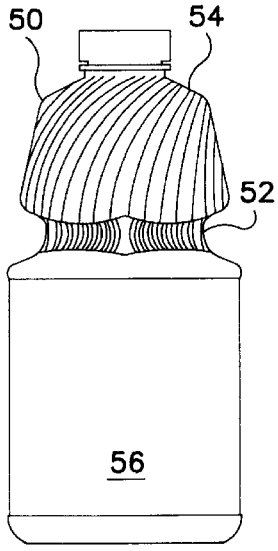
Figure 3C:
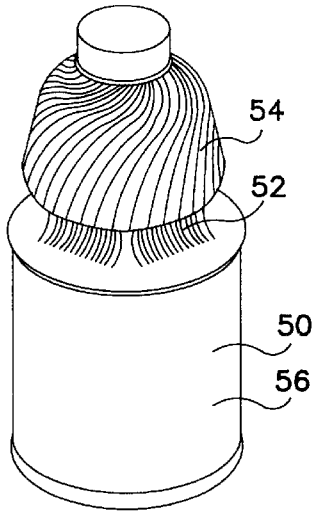

The third embodiment, illustrated in FIGS. 3A, 3B and 3C, provides a container 50 having a grip ring 52, a frustoconical-shaped dome 54 and a body portion 56. Container 50 is identical to the previously described container 10 except for the dome 54 has a plurality of spiral-shaped rib formations for aesthetic and dome reinforcement purposes.

Figure 4A:
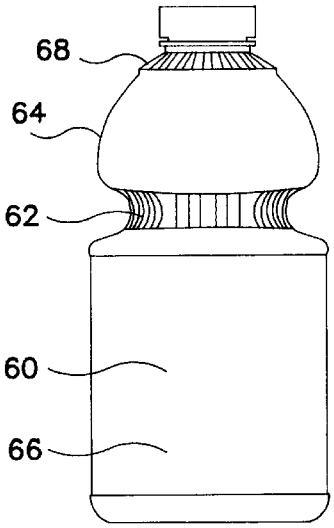
FIGS. 4A, 4B and 4C are elevational and perspective views of a fourth embodiment of a plastic container having a grip ring according to the present invention.
Figure 4B:
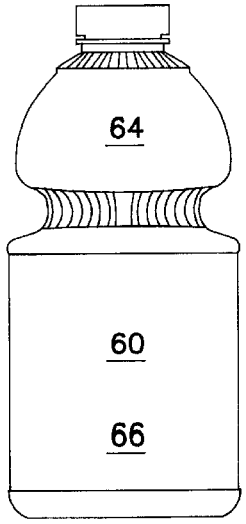
Figure 4C:
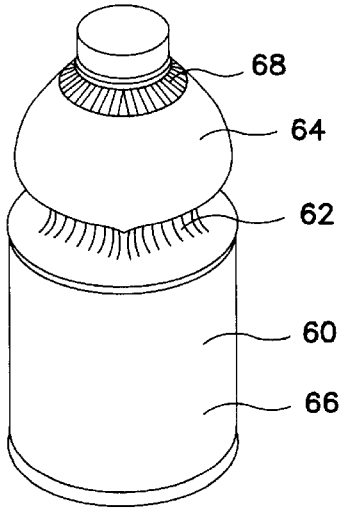

The fourth embodiment, illustrated in FIGS. 4A, 4B and 4C, provides a container 60 having a grip ring 62, a dome 64 and a body portion 66. Container 60 is identical to the previously described container 10 except for the truncated ogive-shape of the dome 64 and for the collar-like ornamentation 68 on the top of the dome 64.

Figure 5A:
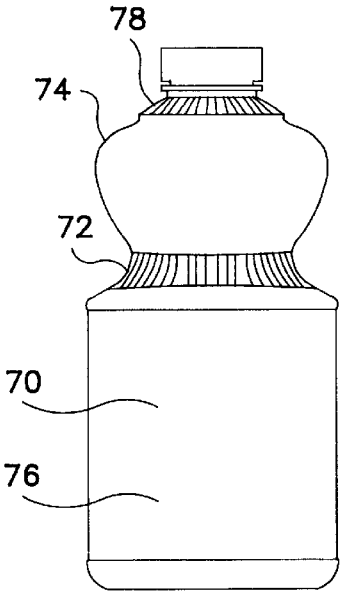
FIGS. 5A, 5B and 5C are elevational and perspective views of a fifth embodiment of a plastic container having a grip ring according to the present invention.
Figure 5B:
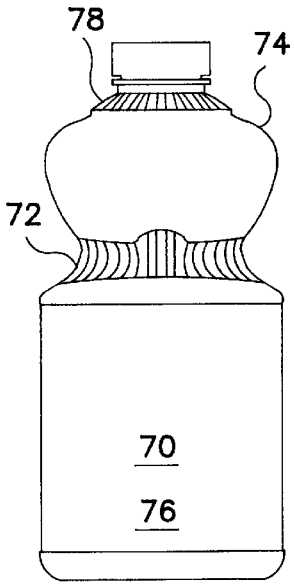
Figure 5C:
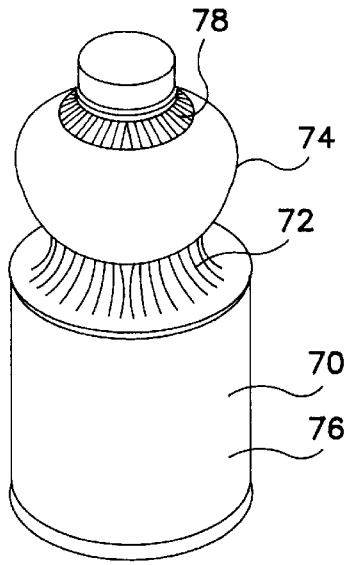

The fifth embodiment, illustrated in FIGS. 5A, 5B and 5C, provides a container 70 having a grip ring 72, a dome 74 and a body portion 76. Container 70 is identical to the previously described container 10 except for the inverted truncated ogive-shape of the dome 74 and for the collar-like ornamentation 78 on the top of the dome 74.

Figure 6A:
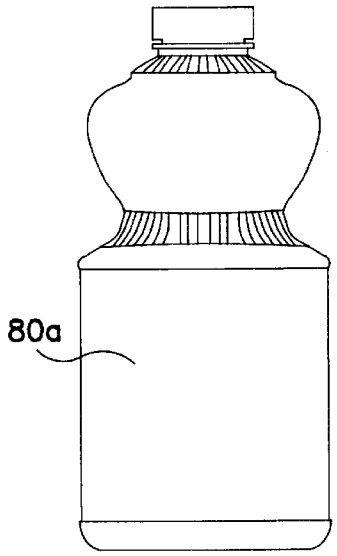
FIGS. 6A, 6B and 6C are elevational and perspective views of a sixth embodiment of a plastic container having a grip ring according to the present invention.
Figure 6B:
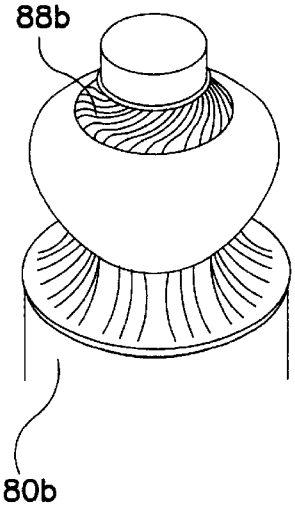
Figure 6C:
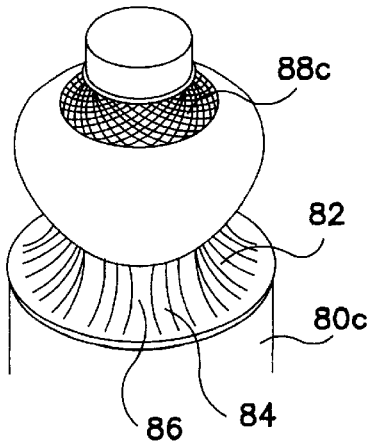

The sixth embodiment, illustrated in FIGS. 6A, 6B, and 6C, provides containers 80*a*, 80*b*, and 80*c* which are similar to the container 70 discussed above. The collar-like ornamentation 88*b* on container 80*b* has ribs extending in a swirl configuration, and the collar-like ornamentation 88*c* on container 80*c* has ribs extending in a crisscross configuration. In addition, the container 80*c* has a grip ring 82 which has ten multi-faceted grip surfaces 84 each having opposite ends defined by axially extending peripherally-spaced ribs 86.

Figures 7A, 7B, 7C:
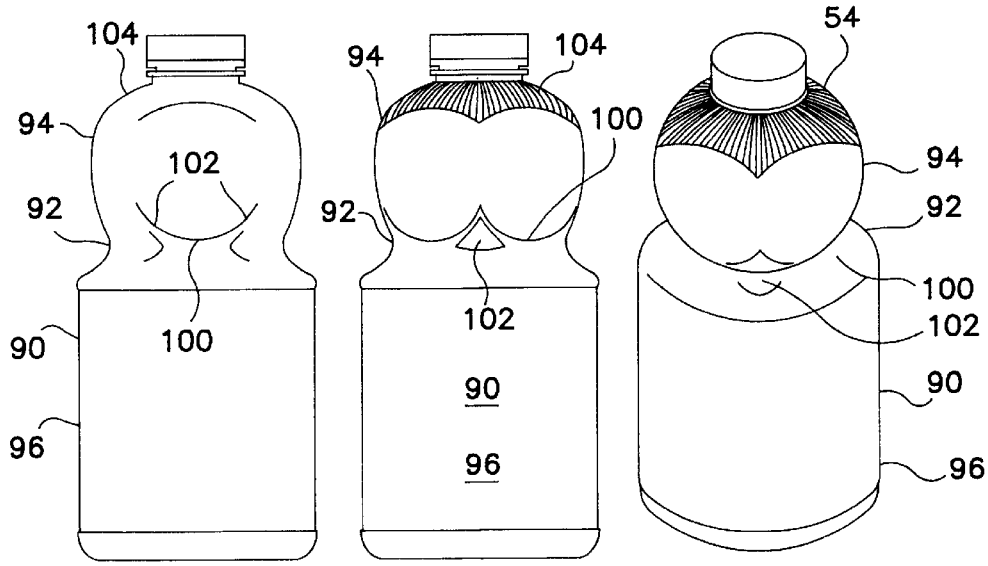
FIGS. 7A, 7B and 7C are elevational and perspective views of a seventh embodiment of a plastic container having a grip ring according to the present invention.

The seventh embodiment, illustrated in FIGS. 7A, 7B and 7C, provides a container 90 having a grip ring 92, a dome 94 and a body portion 96. The container 90 is similar to the previously described container 10 with a few exceptions. For instance, the grip ring 92 has five multi-faceted grip surfaces 100 each having opposite ends defined by diamond-shaped ribs 102. In addition, the overall shape of the dome 94 is bulbous, and the top of the dome 94 has a star-shaped collar-like ornamentation 104.

Figures 8A, 8B, 8C:
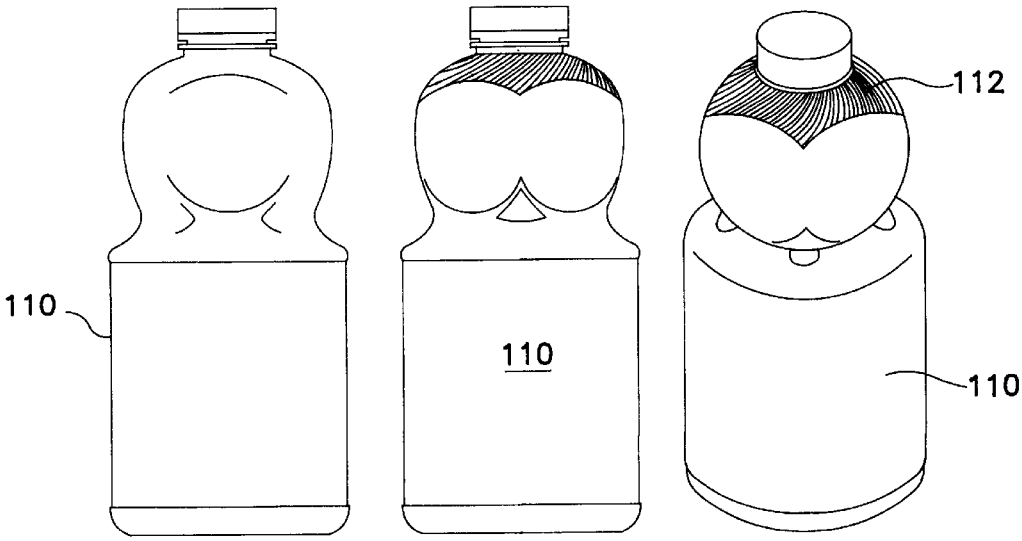
FIGS. 8A, 8B and 8C are elevational and perspective views of an eighth embodiment of a plastic container having a grip ring according to the present invention.

The eighth embodiment, illustrated in FIGS. 8A, 8B, and 8C, provides a container 110 which is substantially identical to the container 90 discussed above. The star-shaped collar-like ornamentation 112 on container 110 has ribs extending in a swirl configuration.

Figures 9A, 9B, 9C:
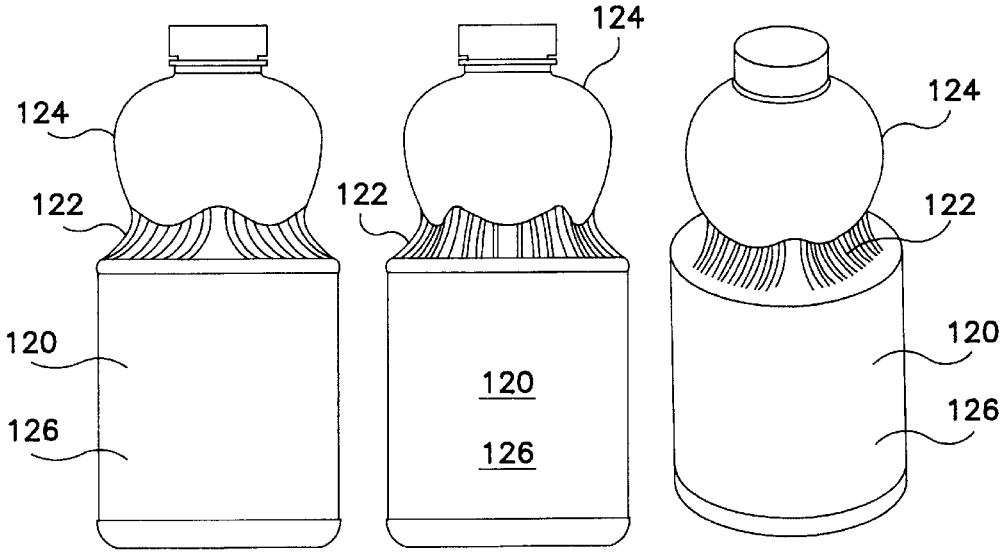
FIGS. 9A, 9B and 9C are elevational and perspective views of a ninth embodiment of a plastic container having a grip ring according to the present invention.

The ninth embodiment, illustrated in FIGS. 9A, 9B and 9C, provides a container 120 having a grip ring 122, a dome 124 and a body portion 126. Container 120 is similar to the previously described container 10 except for the dome 124 having a bulbous shape.

Figures 10A, 10B, 10C:
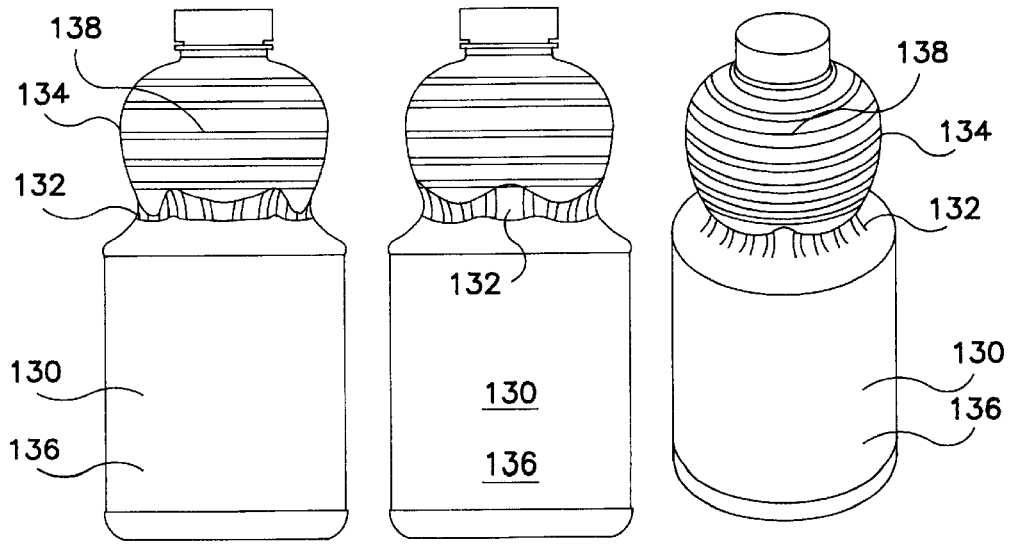
FIGS. 10A, 10B and 10C are elevational and perspective views of a tenth embodiment of a plastic container having a grip ring according to the present invention.

The tenth embodiment, illustrated in FIGS. 10A, 10B and 10C, provides a container 130 having a grip ring 132, a bulbous-shaped dome 134 and a body portion 136. Container 130 is substantially identical to the previously described container 120 except for the dome 134 has a plurality of circumferential ribs 138 for aesthetic and dome reinforcement purposes.

Figures 11A, 11B, 11C:
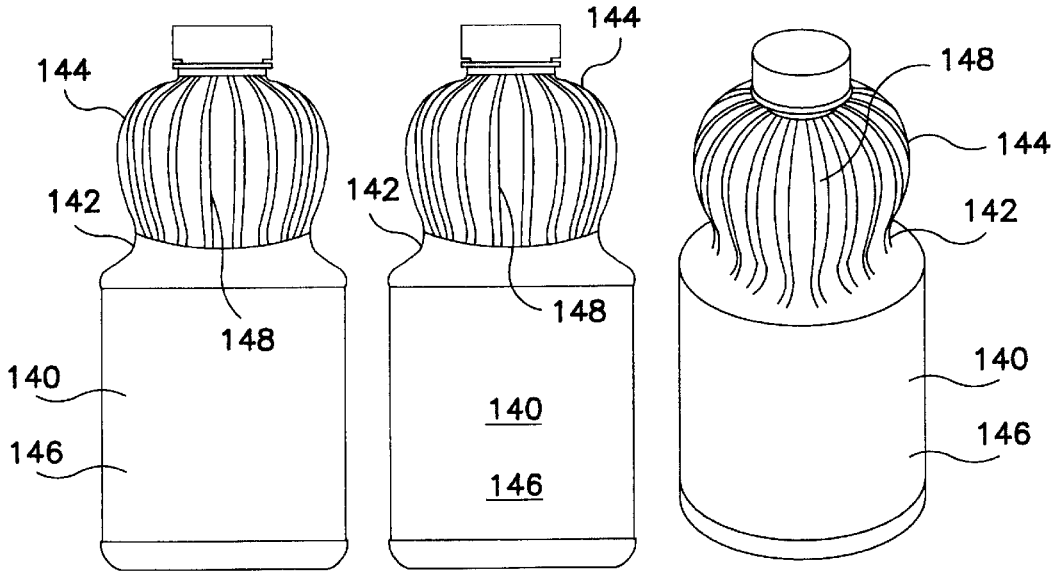
FIGS. 11A, 11B and 11C are elevational and perspective views of an eleventh embodiment of a plastic container having a grip ring according to the present invention.

The eleventh embodiment, illustrated in FIGS. 11A, 11B and 11C, provides a container 140 having a grip ring 142, a bulbous-shaped dome 144 and a body portion 146. Container 140 is substantially identical to the previously described container 120 except for the dome 144 has a plurality of axial ribs 148 extending from the grip ring 142 to the finish for aesthetic and dome reinforcement purposes.

Figures 12A, 12B:
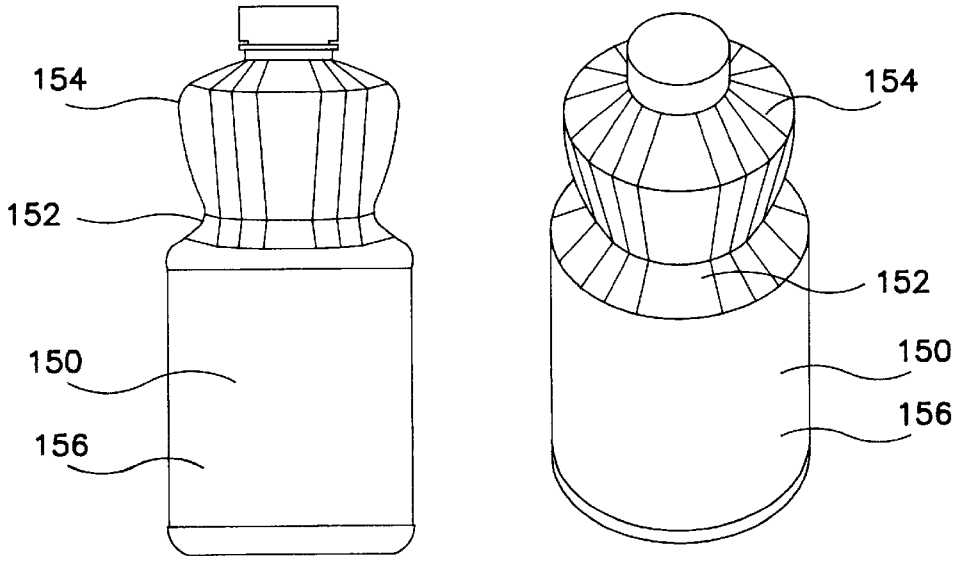
FIGS. 12A and 12B are elevational and perspective views of a twelfth embodiment of a plastic container having a grip ring according to the present invention.

Finally, the twelfth embodiment, illustrated in FIGS. 12A and 12B, provides a container 150 having a grip ring 152, a dome 154 and a body portion 156. The container 150 is similar to the previously described container 10 with a few exceptions. For instance, the dome 154 has an overall inverted, truncated ogive-shape formed by a plurality of horizontally extending faceted walls extending from the top of the dome 154 through the multi-faceted grip ring 152.

An important aspect of the present invention is that for each of the above referenced embodiments, the body portions and dome portions have predetermined volumes which are selected relative to the overall container volume in order to enable facile and balanced pouring. For instance, the predetermined body portion volume is in a range of about 60% to about 70% of the overall container volume, and the predetermined dome portion volume is in a range of about 30% to about 40% of the overall container volume. Thus, since the grip ring is located between the body and dome portions, the grip ring is in a location which is adjacent the center of gravity of the container and its contents. This relationship fosters balanced and facile pouring of the contents of the container when the container is gripped with one hand about the grip ring.

Another important concept is that for each of the above referenced embodiments, the grip ring has a predetermined height relative to the overall height of the container. For instance, the predetermined height of the grip ring is in a range of about 60% to about 70% of the overall height of the container. Thus, the combination of the relative size and location of the grip ring fosters balanced and facile pouring.

An additional concept of the present invention is that each grip surface of each grip ring according to the present invention is inset from the outer periphery of the body portion so that the container can be grasped in a ready and sturdy manner adjacent the center of gravity of the container and its contents. For instance, the inset is selected so that it is in a range of about 60% to about 75% of the transverse dimension of the body portion.

The described containers have improved waist constructions to provide enhanced controllable pouring capability. The containers can be efficiently and inexpensively blow-molded from any of several commercially-available plastics, such as PET, and provide an aesthetic appearance despite the rigors of hot-fill processing and top loading during shipping. In addition, the location and configuration of the grip rings provide a circumferential hoop structure which prevents the dome and the sidewall of the container from unwanted ovalization distortion.

While preferred containers have been described in detail, various modifications, alterations, and changes may be made without departing from the spirit and scope of the present invention as defined in the appended claims.

What is claimed is:

1. A grippable, balanced pour blow-molded container, comprising:

a body portion having a first predetermined volume for containing a liquid;

a dome portion above said body portion having a second predetermined volume for containing a liquid; and a grip ring located between said body portion and said dome portion;

said grip ring having a peripheral multi-faceted grip surface entirely inset from adjacent outer annular peripheries of said body portion and said dome portion, said multi-faceted grip surface having at least five, identical, horizontally-elongate, digit-engageable surfaces extending chordally with respect to said outer annular periphery of said body portion in an end-to-end configuration;

said grip ring having an inwardly and upwardly radially extending lower grip surface portion adjacent said body portion and an inwardly and downwardly extending upper grip surface portion adjacent said dome portion;

said grip ring having a vertically-elongate, axially-extending reinforcement post rib located at each end-to-end juncture of said digit-engageable surfaces, said post ribs connecting to said upper and lower grip surface portions and extending a spaced distance from, and entirely within, said adjacent outer annular peripheries of said body and dome portions; and said grip ring having a plurality of vertically-elongate, horizontally-spaced apart, axially-extending anti-slippage ribs formed on each of said digit-engageable surfaces to prevent distortion of said digit-engageable surfaces and to provide slippage resistance grippable surfaces;

said first predetermined body portion volume being in a range of about 60% to about 70% of the overall volume of the container, and said second predetermined dome portion being in a range of about 30% to about 40% of the overall volume of the container;

whereby the grip ring is located and sized relative to the body portion and dome as to enable gripping, lifting and pouring of the container contents in a facile manner.

2. The container according to claim 1, wherein the container has a predetermined axial height and wherein said grip ring is located in a range of about 60% to about 70% of said height.

3. The container according to claim 2, wherein said dome portion has a circular transverse cross-section above said grip ring forming a bulbous configuration.

4. The container according to claim 2, wherein said dome portion has a frustoconical configuration.

5. The container according to claim 2, wherein said dome portion has a truncated ogive-shaped configuration.

6. The container according to claim 5, wherein said truncated ogive-shaped configuration is inverted.

7. A grippable, balanced pour blow-molded container according to claim 2, wherein each of said digit-engageable surfaces bows inwardly between adjacent post ribs.

8. A grippable, balanced pour blow-molded container according to claim 2, wherein each of said digit-engageable surfaces extend substantially planar between adjacent post ribs.

* * * * *